US011613966B2

(12) United States Patent
Bair et al.

(10) Patent No.: US 11,613,966 B2
(45) Date of Patent: Mar. 28, 2023

(54) MECHANICAL DRAIN FOR OILFIELD SERVICE

(71) Applicant: Black Gold Pump and Supply, Inc., Signal Hill, CA (US)

(72) Inventors: Michael Bair, Los Angeles, CA (US); Simon Shin, Los Angeles, CA (US); Bao Binh H Nguyen, Los Angeles, CA (US)

(73) Assignee: Black Gold Pump and Supply, Inc., Signal Hill, CA (US)

( * ) Notice: Subject to any disclaimer, the term of this patent is extended or adjusted under 35 U.S.C. 154(b) by 40 days.

(21) Appl. No.: 17/382,759

(22) Filed: Jul. 22, 2021

(65) Prior Publication Data

US 2023/0023843 A1 Jan. 26, 2023

(51) Int. Cl.

| | |
|---|---|
| ***E21B 34/14*** | (2006.01) |
| ***E21B 34/12*** | (2006.01) |
| ***E21B 34/06*** | (2006.01) |

(52) U.S. Cl.

CPC ..... *E21B 34/12* (2013.01); *E21B 34/063* (2013.01); *E21B 34/14* (2013.01); *E21B 2200/06* (2020.05)

(58) Field of Classification Search

CPC ..... E21B 34/063; E21B 34/14; E21B 34/142; E21B 2200/06; E21B 33/00

See application file for complete search history.

(56) References Cited

U.S. PATENT DOCUMENTS

| | | | | |
|---|---|---|---|---|
| 4,645,007 A | | 2/1987 | Soderberg | |
| 4,807,699 A | | 2/1989 | Sample | |
| 4,934,460 A | * | 6/1990 | Coronado | E21B 34/103 166/321 |
| 5,782,303 A | * | 7/1998 | Christian | E21B 43/127 166/373 |
| 8,281,866 B2 | | 10/2012 | Tessier et al. | |
| 2015/0354318 A1 | | 12/2015 | Wright | |

* cited by examiner

*Primary Examiner* — Catherine Loikith

(74) *Attorney, Agent, or Firm* — James M. Duncan; Scanlon Duncan LLP

(57) ABSTRACT

A mechanically actuated tubing drain for service with oil wells, water wells, gas wells and/or thermal wells has a configuration in which the drain opens by operation of a bumper member which may be pulled upwardly to move a sleeve member which is initially positioned adjacent to a drain port, thereby sealing the drain port. Once the bumper member pushes the sleeve member upwardly, any fluid in the tubing above the drain port will drain from the tubing. The bumper member may be pulled upwardly either by upward movement of a rod string or by operation of a wireline or slickline tool. The mechanically actuated drain does not require a tubing anchor to operate.

13 Claims, 6 Drawing Sheets

MECHANICAL DRAIN FOR OILFIELD SERVICE

BACKGROUND OF THE INVENTION

This invention relates to devices for draining fluids from a tubing string in a hydrocarbon production well. Tubing drains allow fluids to drain from the tubing string of a well. Among other purposes, draining fluid from the tubing string allows the tubing to be removed from a well without pulling the tubing "wet", which occurs when there is an obstruction in the tubing which prevents the fluid from draining out of the bottom of the tubing. For example, if the well is produced with a rod pump and the rods have parted leaving a pump or plunger at the bottom of the tubing string, the tubing will stand full of fluid requiring the well to be pulled wet, unless a drain can be actuated which allows the fluid to escape from the inside of the tubing into the casing-tubing annulus. Pulling the tubing wet can result in produced fluid being spilled on the ground surface as well as potentially spraying the production rig crew as the tubing joints are unscrewed. Such releases may violate a variety of laws and regulations, including those pertaining to environmental protection and occupational health and safety.

Tubing drains may be either activated by manipulation of the tubing, typically by rotation, or by applying pressure to the tubing string to a sufficiently high pressure to burst one or more rupture discs contained within the tubing drain. In the case of the hydraulic drain a pressure truck or high-pressure surface pump must be employed to apply the hydraulic pressure required to open the drain. In the case of the known mechanical drains, with one variety the sucker rod string is first pulled with a pulling hoist and then a ball, bar or dart is dropped down the tubing to knock out shear pins open the drain. Both of the above mechanisms leave debris in the well, such as remnants of pressure discs and shear pins.

Other types of tubing drains may be opened by rotation of the tubing string. For example, the Applicant herein owns U.S. Pat. No. 10,337,286 which discloses a mechanical drain which may be opened and closed by rotation of the tubing string.

Each type of known drain has operational limitations. For example, there are situations where rotation of the tubing may not be achievable, such as in highly deviated wells or when it is not possible to set a downhole plug required for hydraulically pressurizing the tubing to actuate a hydraulic drain. It is to be noted that there are no known mechanically actuated drains for unanchored tubing strings. A drain actuation device which allows draining of the tubing when these and other situations are present would be beneficial.

SUMMARY OF THE INVENTION

Embodiments of the method and apparatus disclosed herein provide a solution to the problems described above. For purposes of this disclosure, the terms "lower," "bottom," "downward," etc., refer to a direction facing toward the bottom of a well and the terms "upper," "top," "up," etc., refer to a direction facing toward the surface. The terms "inward" and "inwardly" refer to a direction facing toward the central axis of the disclosed mechanical drain and the terms "outward" and "outwardly" refer to a direction facing towards the inside wall of the casing string.

An embodiment of the apparatus is utilized in hydrocarbon producing wells for draining a tubing string which is disposed within a length of well casing. Embodiments of the mechanical drain have a tubular member, which may comprise either a single piece mandrel or which may comprise an upper connector member and a lower mandrel member. The tubular member is made up into the tubing string, typically with either a box-to-pin configuration, where the tubular member has a box with internal threads on one end for receiving a threaded male pin and a pin with external threads on the opposing end, a box-to-box configuration where each end of the tubular member has a box with internal threads, or a pin-to-pin configuration where the tubular member has threaded male ends on each end which are made up into adjacent tubing couplings.

The tubular member of the mechanical drain has an axially aligned opening which has an inside diameter which, in accord with oilfield practice, is typically at least as large as the inside diameter of the tubing comprising the tubing string. The axially aligned opening of the tubular member has a central axis which may be, but not necessarily, offset from a central axis of the tubular member.

The tubular member has an outside surface and an inside surface. The inside surface has an upper bore section and a lower bore section which is contiguous with the upper bore section. The lower bore section comprises a drain port extending through the tubular wall from the inside surface to the outside surface. The term "drain port" is defined herein to include multiple ports, each set within the lower bore section. The drain port (or drain ports) may have a diameter ranging from one-half inch to three-quarter inch.

The mechanical drain also has a sleeve member which has a top and a bottom. The sleeve member is configured to be releasably retained within the lower bore section of the tubular member by a plurality of shear pins, which typically are threaded brass screws which extend between the tubular member and the sleeve member. The sleeve member is described as being releasably retained within the lower bore section because shearing of the shear screws will allow the sleeve to be axially moved within the tubular member. The sleeve member is initially disposed across the drain port such that the sleeve member prevents a flow of fluid through the drain port when the sleeve member is retained within the lower bore section. The sleeve member may have O-ring grooves and utilize elastomeric O-rings to provide a fluid-tight seal to prevent fluid flow out of the drain port while the sleeve member is retained in the lower bore section.

The mechanical drain also has a bumper member which is disposed in a first position below the sleeve member. The bumper member is raisable to a second position at which point the bumper member engages the bottom of the sleeve member thereby causing the plurality of shear pins to shear and driving the top of the sleeve member into the upper bore section thereby uncovering the drain port and allowing a fluid to flow through the drain port to an exterior of the mechanically actuated drain. The bumper member may have an upper section which has a configuration which provides for an improved fluid flow in the tubing string around the bumper member. For example, the bumper member may have a fluted or lobed configuration to improve the fluid flow. The bumper member may also comprise an internal threaded portion for connecting to a threaded member, such as a downward facing threaded pin of a sucker rod. Alternatively, the bumper member may have an upper end configured to be engaged by a tool run in on slick line or wire line.

Embodiments of the mechanical drain may comprise a single piece mandrel which comprises both the upper bore section and lower bore section. In the single piece embodiment, once upward force is no longer applied to the bumper member, such as when the rod string above the bumper member separates at a disconnect tool, the sleeve member is retained in the upper bore section of the tubular member by various mechanisms, which may be assisted by the expansion of O-rings on the sleeve member as it is pulled into the upper bore section. This prevents the drain from resealing after the upward force is released on the bumper member.

Alternatively, embodiments of the mechanical drain may comprise a mandrel member having the lower bore section, and an upper connector member, where the upper connector member comprises the upper bore section. In this alternative embodiment, the sleeve member may comprise a plurality of outside diameters in a graduated configuration, with the plurality of outside diameters increasing in size from a smallest outside diameter at the top of the sleeve member and increasing with respect to an axial distance away from the top of the sleeve member (i.e., moving toward the bottom of the sleeve member). With this configuration, the upper bore section has an internal diameter having a wedge configuration with the internal diameter decreasing in size axially toward the upper end. With this embodiment, the graduated configuration of the outside diameters of the sleeve member and the wedge configuration of the internal diameter of the upper bore section cooperatively act to retain the sleeve member in the second position upon the raising of the sleeve member by the bumper member generating an interference fit between the outside diameter of the sleeve and the internal diameter of the upper bore section.

In one application of the invention, a rod string may be utilized to operate a subsurface pump which is set below the mechanical drain, with a portion of the rod string passing through the mechanical drain. In this installation, an embodiment of the mechanical drain has the bumper member depending from a rod of the rod string, where the rod string can be utilized to raise the bumper member from the first position to the second position. Thus, the rod string can be utilized to open the mechanical drain by raising the rod string a particular length.

Embodiments of the invention might be operated by alternative means. For example, an embodiment of the mechanical drain might have a bumper member having an upper member configured to be engaged by a slick line or wire line recovery tool. With this embodiment, an embodiment of the presently disclosed mechanical drain might be utilized to drain tubing of wells which do not utilize rod strings.

DETAILED DESCRIPTION OF THE EMBODIMENTS

Figure 1:
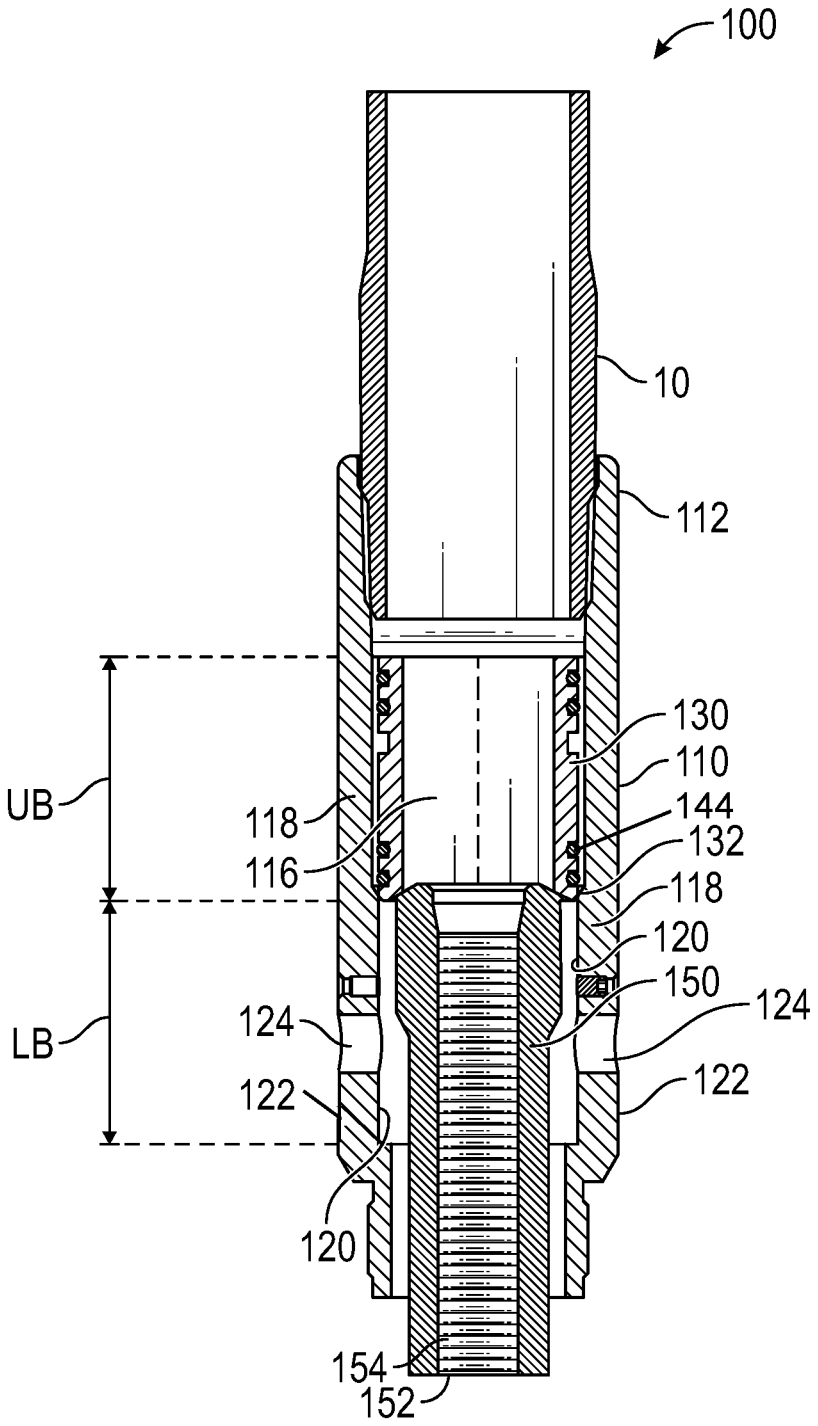
FIG. 1 depicts a sectioned view of an embodiment of a mechanical drain comprising a single piece mandrel with the sleeve member pulled into an upper bore section of the mandrel.
Figure 2:
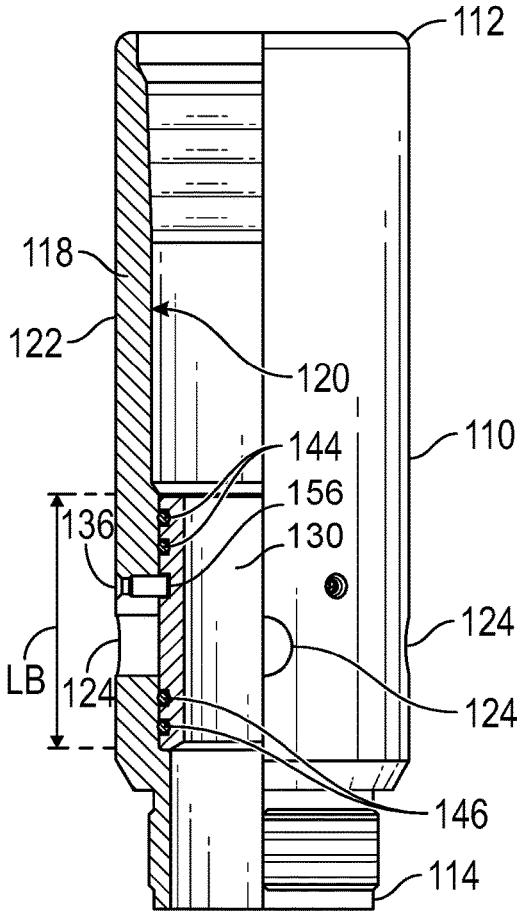
FIG. 2 shows a quarter-sectioned view of a tubular member of an embodiment of a mechanical drain, the tubular member comprising a single piece mandrel.
Figure 3:
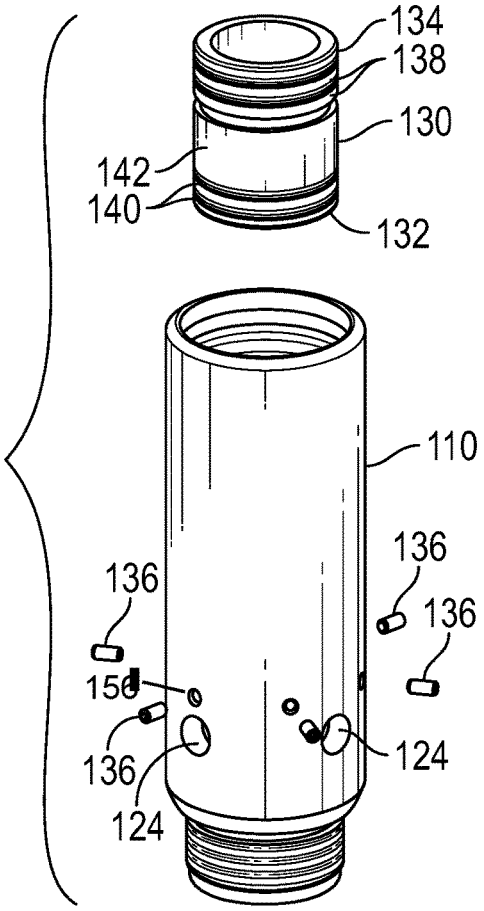
FIG. 3 depicts an exploded view of the single piece mandrel and sleeve shown in FIG. 2.

Referring specifically to the figures, two basic embodiments of the presently disclosed invention are depicted. The first embodiment 100 of the mechanical drain has a one-piece tubular member 110 or mandrel as depicted in FIGS. 1-3. First embodiment 100 may provide a sleeve member 130 having larger inside diameter by utilizing tighter tolerances between the outside diameter of the sleeve member and the inside diameter of the tubular member 110.

Second embodiment 200 utilizes a two-piece tubular member 210 which provides looser tolerances between the outside diameter of the sleeve member 250 and the inside diameter of the tubular member, thereby providing an embodiment in which the sleeve member 250 has a smaller inside diameter than the inside diameter of the sleeve member 130 utilized in the one-piece tubular member 110. Each embodiment will have specific benefits depending upon the characteristics of a particular well.

The first embodiment of the mechanical drain 100 is connected at its upper end to a joint of tubing 10 suspended from a string of tubing which extends to the surface of the well. A string of sucker rods may run through the tubing string and extend through the mechanical drain 100 and connect to a pump assembly, such as a plunger for a tubing pump below the mechanical drain 100.

Mechanical drain 100 comprises a tubular member 110, also referred to herein as a single piece mandrel. Tubular member 110 comprises an upper end 112, a lower end 114 and an axially aligned opening 116 extending between the upper end and the lower end. Tubular member 110 has a tubular wall 118 having an inside surface 120 and an outside surface 122. The inside surface has an upper bore section UB and a lower bore section LB which is contiguous with the upper bore section. The lower bore section LB has at least one drain port 124 which extends through the tubular wall 118 from the inside surface 120 to the outside surface 122.

Mechanical drain 100 also comprises a sleeve member 130. Sleeve member 130 is initially disposed within the lower bore section LB and pinned into place in that section as discussed below. When desired, sleeve member 130 may be raised into upper bore section UB by utilizing an upward pulling means. FIG. 1 depicts sleeve member 130 after it has been pulled into the upper bore section.

Figure 13:
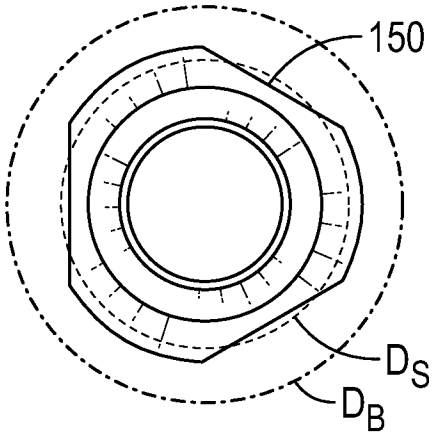
FIG. 13 depicts a top view of the bumper member depicted in FIG. 11, showing the outside diameter of the bumper member to the inside diameters of the pump barrel diameter and the sleeve member, each shown by dashed lines.
Figure 12:
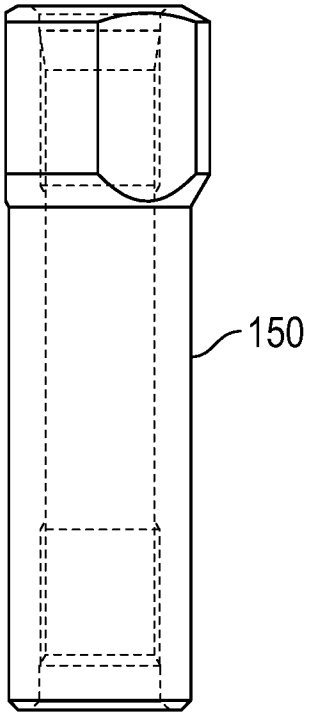
FIG. 12 depicts a side view of the bumper member depicted in FIG. 11.
Figure 11:
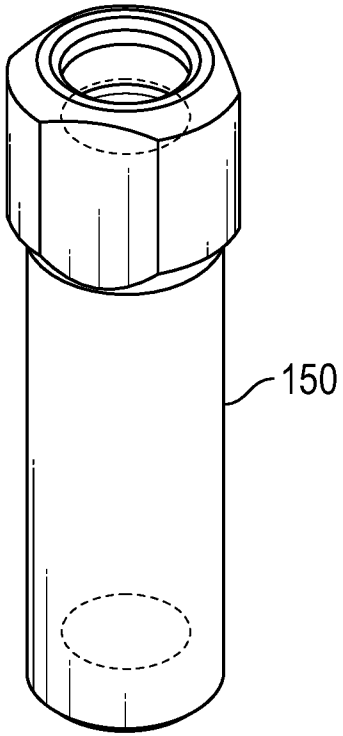
FIG. 11 depicts a perspective view of an embodiment of a bumper member which might be utilized in embodiments of the present invention.

Mechanical drain 100 also comprises a bumper member 150, shown in greater detail in FIGS. 11-13. When used in a tubing pump configuration, bumper member 150 may be made up to the pump plunger or to a plunger extension which attaches to the plunger. The lower end of bumper member 150 may be configured to attach to a plunger assembly. Bumper member 150 is installed with the pump plunger set within the pump barrel which is run in with the tubing string.

As indicated in FIG. 13, bumper member 150 has a lobed configuration having a minimum diameter and a maximum diameter. FIG. 13 shows the minimum and maximum outside diameters of the bumper member 150 with respect to the relative inside diameter DB of the pump barrel and the inside diameter Ds of the sleeve member 130 shown in dashed lines.

Bumper member 150 is disposed in a first position which is below lower bore section LB. The bumper member 150 is raisable to a second position where the bumper member 150 engages the bottom 132 of sleeve member 130 thereby pushing sleeve member 130 into upper bore section LB as depicted in FIG. 1. As shown in FIG. 1, bumper member 150 has axial opening 152. Axial opening 152 may comprise internal threads 154 which may extend through the length of bumper member 150 as shown in FIG. 1. Alternatively, internal threads 154 may extend for just a portion of the axial opening 152. The pin end of a pump rod (not shown) run in on a rod string may be made up to internal threads 154 of bumper member 150. Alternatively, bumper member 150 may have an upper end configured to be grasped by a tool run in with slickline or wireline.

Sleeve member 130 has a bottom 132 and a top 134. FIG. 2 depicts sleeve member 130 in its initial position set within lower bore section LB by shear pins 136 which extend through tubular member 110 into apertures 156 in the exterior wall of sleeve member 130. Shear pins 136 may be threaded brass screws and apertures 156 may have internal threads for receiving threaded shear pins.

As illustrated in FIG. 2, when the sleeve member 130 is in its initial position it is held by shear pins 136. In its initial position, sleeve member 130 is positioned over drain port(s) 124. Sleeve member 130 may have upper O-ring grooves 138 and lower O-ring grooves 140 which are respectively disposed above and below a smooth wall section 142. O-rings 144 are disposed within upper O-ring grooves 138 and O-rings 146 are disposed within lower O-ring grooves 140. When sleeve member 130 is in its initial position within lower bore section LB, smooth wall section will be disposed adjacent and across drain port(s) 124 with O-ring grooves 138 with O-rings 144 positioned above the drain port(s) and O-ring grooves 140 with O-rings 144 positioned below the drain port(s). Thus, when sleeve member 130 is in its initial position within lower bore section LB, fluid flows through the axially aligned opening through the mechanical drain and through the tubing string and drain port 124 is sealed from any fluid flow by sleeve member 130. This is the configuration of the mechanical drain when the well is on production.

As discussed above, FIG. 1 depicts at least the top of sleeve member 130 seated within upper bore section UB. Sleeve member 130 is pushed into upper bore section UB by bumper member 150 when bumper member 150 is pulled from a first position below the lower bore section LB into a second position where the bumper member 150 engages the bottom 132 of sleeve member 130. Further upward movement of bumper member 150 causes shear pins 136 to break and allows at least the top of sleeve member 130 to be pushed into the upper bore section UB, thereby uncovering drain port(s) 124 and allowing fluid to exit the tubing by flowing out through the uncovered drain port(s). It is to be noted that when the top of sleeve member 130 is pushed into the upper bore section UB by bumper member 150, shear pin fragments are retained within tubular member 110 and within the apertures 156 of the sleeve member 130, such that no shear pin fragments end up falling into the wellbore. Bumper member 150 may be pulled upward to raise sleeve member 130 either by raising of the rod string or by upward force applied by a slick line or wire line.

In this embodiment of the mechanical drain 100, once sleeve member 130 is pulled into the upper bore section UB the sleeve member remains in the upper bore section even after the upward force is release, such as when the portion of the rod string above the mechanical drain is disconnected. Although the upper bore section UB has a larger diameter than the lower bore section LB, the dimensional tolerances between the outside diameter of the sleeve member 130 and the inside diameter of the upper bore section of the tubular member 110 are sufficiently tight that once the sleeve member is pulled into the upper bore section the O-rings will expand sufficiently to prevent the sleeve from falling back into the lower bore section LB even after the upward tension is removed from the bumper member 150.

FIGS. 4-10 depict components of a second embodiment 200 of the mechanical drain. It is to be appreciated that the same bumper member 150 shown in FIGS. 11-13 may be utilized with both the first embodiment 100 and the second embodiment 200. While FIGS. 4-10 do not show bumper member 150, it is to be understood that bumper member 150 is a component of the second embodiment 200.

Mechanical drain 200 comprises a tubular member 210 comprising a lower mandrel member 212 and an upper connector member 214. Lower mandrel member 212 has an upper end 216, a lower end 218 and an axially aligned opening 220 extending between the upper end and the lower end. Lower mandrel member 212 has a mandrel member wall 222 having an inside surface 224 and an outside surface 226. The inside surface 224 has a lower bore section LB. The lower bore section LB has at least one drain port 228 which extends through the mandrel member wall 222 from the inside surface 224 to the outside surface 226.

Figure 4:
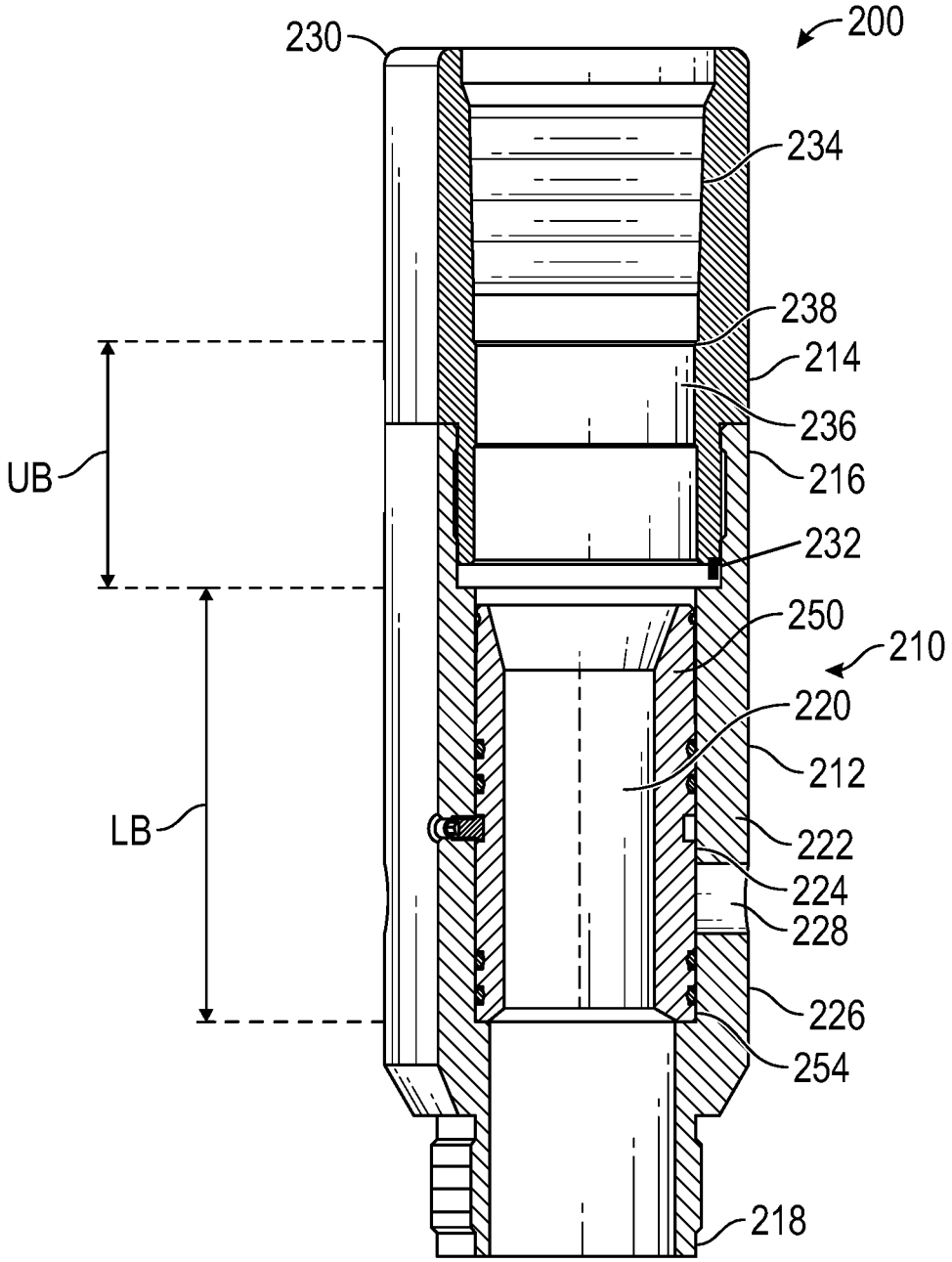
FIG. 4 depicts a sectioned view of the tubular member of an embodiment of the mechanical drain, the tubular member comprising a lower mandrel member and an upper connector member.

Upper connector member 214 comprises an upper end 230 and a lower end 232. As depicted in FIG. 4, the lower end 232 of upper connector member 214 may comprise a pin end and lower mandrel member 212 may comprise a box end for receiving the pin end of the upper connector member 214. However, this configuration may be reversed as desired for the application and without changing the scope or purpose of the invention. Upper end 230 of the upper connector member 214 is connected to a joint of the tubing string above the mechanical drain 200.

Upper connector member 214 has an inside surface 234 having an upper bore section UB which is adjacent to the lower bore section LB of the lower mandrel member 212. Upper bore section UB comprises an axial section 236 having internal diameter in a wedge configuration with the internal diameter decreasing in size axially upward through the upper bore section UB to a terminus 238 of the upper bore section.

Figure 7:
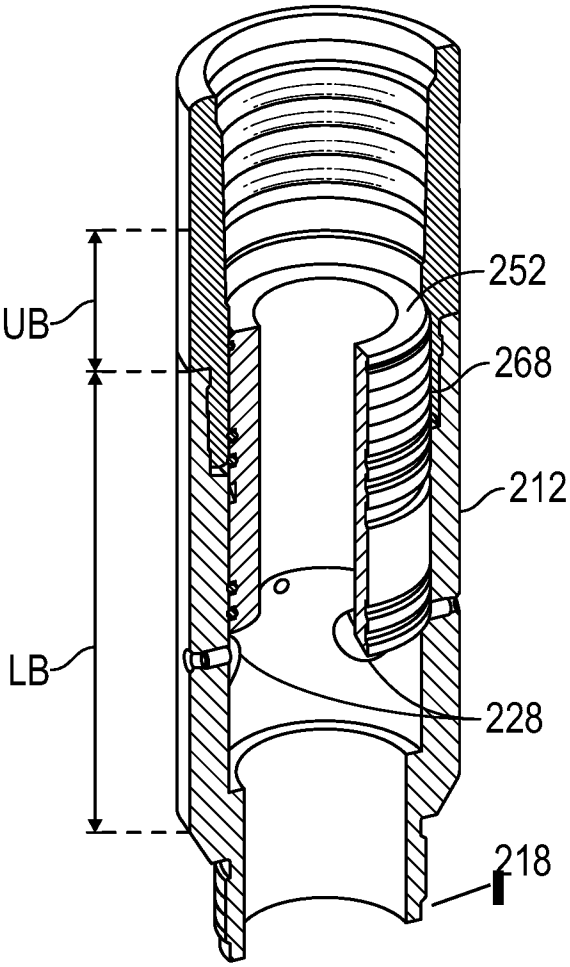
FIG. 7 shows a sectioned view of the of the lower mandrel member, upper connector member and the sleeve member shown in FIG. 5.
Figure 6:
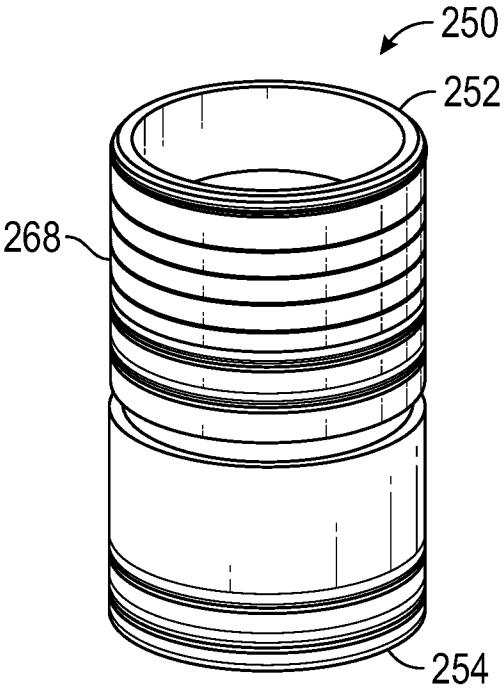
FIG. 6 shows an embodiment of a sleeve member of FIG. 5.
Figure 5:
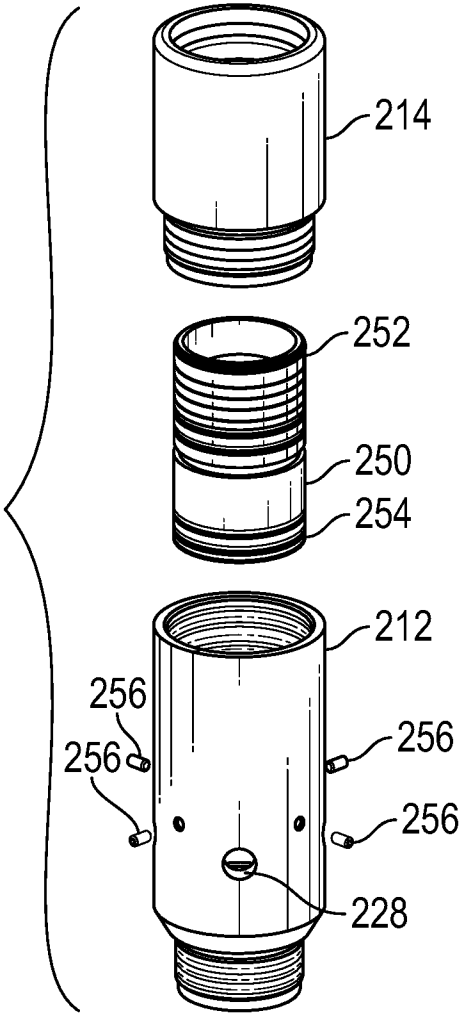
FIG. 5 depicts an exploded view of an assembly comprising a lower mandrel member, an upper connector member and a sleeve member utilized in an embodiment of the mechanical drain.
Figure 10:
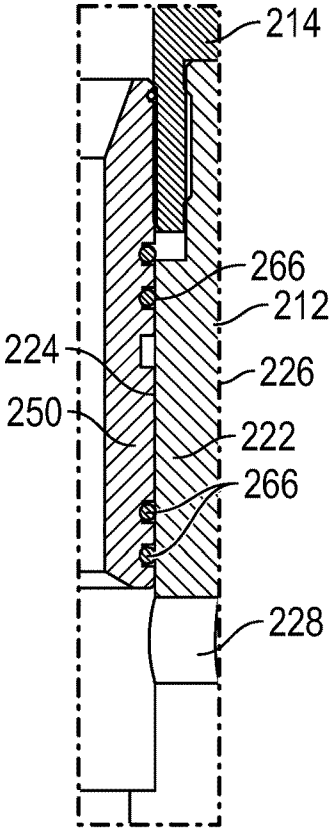
FIG. 10 shows a sectioned view of a portion of the walls of the upper connector, the lower mandrel member and the sleeve member when the sleeve member has been moved into the upper bore section of the lower mandrel member, thereby allowing flow through the drain port.
Figure 9:
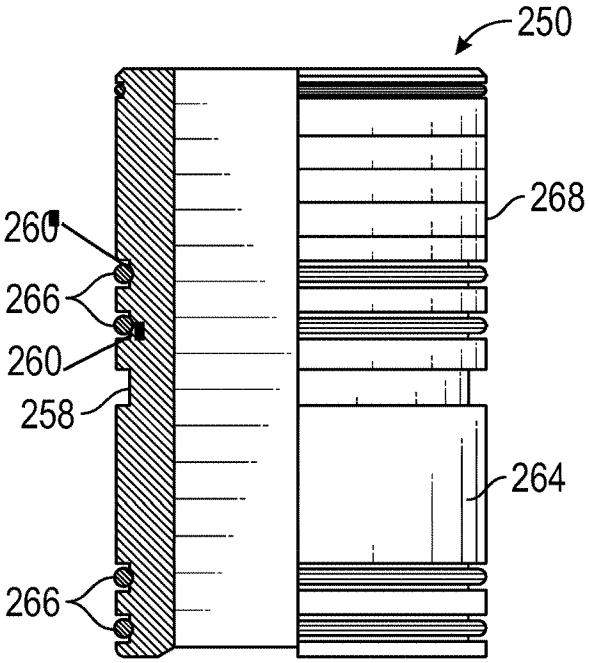
FIG. 9 shows a quarter sectioned view of the sleeve member depicted in FIG. 5.
Figure 8:
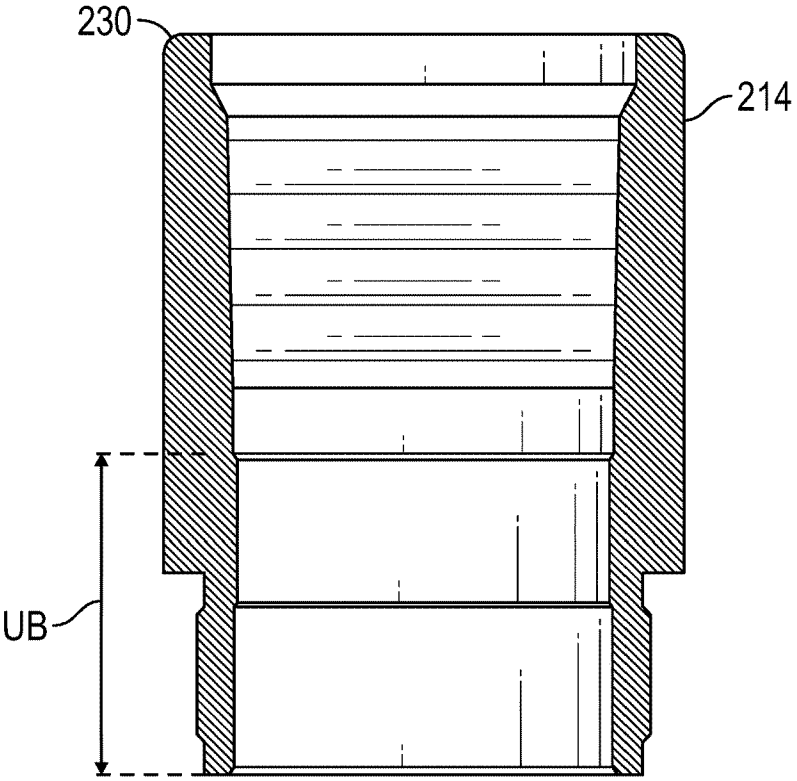
FIG. 8 shows a sectioned view of the upper connector member depicted in FIG. 5.

Mechanical drain 200 also comprises a sleeve member 250. Sleeve member 250 is initially disposed within the lower bore section LB and pinned into place in that section as discussed below. When desired, sleeve member 250 may be raised such that the top 252 of sleeve member 250 is shifted into upper bore section UB as depicted in FIG. 7. by utilizing an upward pulling means on bumper member 150 as described above for the first embodiment of the mechanical drain 100.

Bumper member 150 is disposed in a first position which is below lower bore section LB. The bumper member 150 is raisable to a second position where the bumper member 150 engages the bottom 254 of sleeve member 250 thereby pushing sleeve member 250 upward so that the top 252 of sleeve member 250 is moved into upper bore section LB as depicted in FIG. 7.

FIG. 4 depicts sleeve member 250 in its initial position set within lower bore section LB by shear pins 256 which extend through mandrel member 212 into apertures 258 in the exterior wall of sleeve member 250. Shear pins 256 may be threaded brass screws and apertures 258 may have internal threads for receiving threaded shear pins.

As illustrated in FIG. 4, when the sleeve member 250 is in its initial position it is held by shear pins 256. In its initial position, sleeve member 250 is positioned over drain port(s) 228. Sleeve member 250 may have upper O-ring grooves 260 and lower O-ring grooves 262 which are respectively disposed above and below a smooth wall section 264. O-rings 266 are disposed within upper O-ring grooves 260 and O-rings 266 are disposed within lower O-ring grooves 262. When sleeve member 250 is in its initial position within lower bore section LB, smooth wall section 264 will be disposed adjacent and across drain port(s) 228 with O-ring grooves 260 with O-rings 266 positioned above the drain port(s) and O-ring grooves 262 with O-rings 266 positioned below the drain port(s). Thus, when sleeve member 250 is in its initial position within lower bore section LB, fluid flows through the axially aligned opening through the mechanical drain 200 and through the tubing string and drain port 228 is sealed from any fluid flow by sleeve member 250. This is the configuration of the mechanical drain when the well is on production.

The top 252 of sleeve member 250 is brought into upper bore section UB by bumper member 150 being pulled from a first position below the lower bore section LB into a second position where the bumper member 150 engages the bottom 254 of sleeve member 250. Further upward pushing of sleeve member 250 causes shear pins 256 to break and allows the top 252 of sleeve member 250 to be pushed into the upper bore section UB by bumper member 150. The upward movement of sleeve member 250 uncovers drain port(s) 228 and allows fluid to exit the tubing by flowing out through the uncovered drain port(s). It is to be noted that when sleeve member 250 is pushed upward with sufficient force to break the shear pins, the shear pin fragments are retained within mandrel member 212 and within the apertures 258 of the sleeve member 250 such that no shear pin fragments end up falling into the wellbore. As with mechanical anchor 100, bumper member 150 may be pulled upward to raise sleeve member 250 either by raising of the rod string or by upward force applied by a slick line or wire line.

In this embodiment of the mechanical drain 200, sleeve member 250 has an outside diameter at top 252 which is at a minimum, but which diameter increases in a step configuration between top 252 and a maximum diameter point 268. This configuration of the sleeve member 250 interacts cooperatively with wedge configuration of upper bore section UB described above to wedge the top of sleeve member into the upper bore section as it is pushed upwardly by bumper member 150 to retain sleeve member 250 in the upper position once the upward force applied to bumper member 150 is stopped, thereby preventing the sleeve member 250 from falling back into the lower bore section LB and covering drain port 228

While the above is a description of various embodiments of the present invention, further modifications may be employed without departing from the spirit and scope of the present invention. Thus the scope of the invention should not be limited according to these factors, but according to the following appended claims.

What is claimed is:

1. A mechanically actuated drain for draining a tubing string in an oilwell, the mechanically actuated drain comprising:

a mandrel member having an upper end, a lower end, and an axially aligned opening defined within a mandrel wall, the axially aligned opening extending between the upper end and the lower end, the mandrel wall having an inside surface and an outside surface, the inside surface comprising an upper bore section and an adjacent lower bore section, wherein the lower bore section comprises a drain port extending through the mandrel wall from the inside surface to the outside surface;

a sleeve member having a top and a bottom, the sleeve member configured to be pinned at a first position within the lower bore section by a plurality of shear pins, the sleeve member disposed across the drain port, the sleeve member comprising a first O-ring disposed above the drain port, the sleeve member comprising a second O-ring disposed below the drain port; and a bumper member disposed in an initial position below the sleeve member, the bumper member comprising an upper section having a lobed profile, the bumper member raisable to a secondary position above the drain port, thereby causing the bumper member to engage the bottom of the sleeve member, shear the shear pins and raise the top of the sleeve member into the upper bore section, thereby uncovering the drain port and allowing a fluid to flow through the drain port to an exterior of the mechanically actuated drain.

2. The mechanically actuated drain of claim 1 wherein the upper bore section comprises an internal diameter having a wedge configuration with the internal diameter decreasing in size axially toward an upper terminus of the upper bore graduated outside diameters of the sleeve member and the wedge configuration of the internal diameter of the upper bore section.

3. The mechanically actuated drain of claim 1 wherein each of the plurality of shear pins comprises a threaded brass set screw.

4. The mechanically actuated drain of claim 1 wherein the shearing of the plurality of shear pins results in a first plurality of shear pin fragments left in the sleeve member and a second plurality of shear pin fragments left in the mandrel member.

5. A mechanically actuated drain for draining a tubing string in an oilwell, the mechanically actuated drain comprising:

a tubular member having an upper end, a lower end, and an axially aligned opening defined within a tubular wall, the axially aligned opening extending between the upper end and the lower end, the tubular wall having an inside surface and an outside surface, the inside surface comprising an upper bore section and a contiguous lower bore section, wherein the lower bore section comprises a drain port extending through the tubular wall from the inside surface to the outside surface;

a sleeve member having a top and a bottom, the sleeve member configured to be releasably retained within the lower bore section by a plurality of shear pins, the sleeve member disposed across the drain port, the sleeve member configured to prevent a flow of fluid through the drain port when the sleeve member is retained within the lower bore section; and a bumper member disposed in a first position below the lower bore section, the bumper member comprising an upper section having a lobed profile, the bumper member raisable to a second position wherein the bumper member engages the bottom of the sleeve member thereby causing the plurality of shear pins to shear and driving the top of the sleeve member into the upper bore section, thereby uncovering the drain port and allowing a fluid to flow through the drain port to an exterior of the mechanically actuated drain, wherein the top of the sleeve member is retained in the upper bore section.

6. The mechanically actuated drain of claim 1 wherein the tubular member is a single piece mandrel.

7. The mechanically actuated drain of claim 1 wherein the tubular member comprises an upper connector member and a lower mandrel member detachably connected together by a threaded connection wherein the upper connector member comprises the upper bore section and the lower mandrel comprises the lower bore section.

8. The mechanically actuated drain of claim 1 wherein the upper bore section comprises an internal diameter having a wedge configuration with the internal diameter decreasing in size axially toward the upper end.

9. The mechanically actuated drain of claim 1 wherein the sleeve comprises a plurality of apertures for receiving the plurality of shear pins.

10. The mechanically actuated drain of claim 1 wherein the sleeve comprises an upper O-ring groove having a first O-ring disposed therein, the sleeve further comprising a lower O-ring groove having a second O-ring disposed therein.

11. The mechanically actuated drain of claim 1 wherein the tubular member comprises a plurality of drain ports.

12. The mechanically actuated drain of claim 11 wherein each of the plurality of drain ports has a diameter ranging from one half inch to three-quarter inch.

13. The mechanically actuated drain of claim 1 wherein each of the plurality of shear pins comprises a threaded brass set screw.

* * * * *